United States Patent [19]

Studebaker

[11] 3,992,057

[45] Nov. 16, 1976

[54] SIMPLIFIED ADJUSTABLE CHAIR FOR CHILDREN WITH CEREBRAL PALSY

[76] Inventor: Gary Weldon Studebaker, 9340 Buell St., Downey, Calif. 90241

[22] Filed: Feb. 3, 1975

[21] Appl. No.: 546,305

[52] U.S. Cl. ..... 297/384; 297/416

[51] Int. Cl.[2] ..... A47C 3/00

[58] Field of Search ..... 5/82; 248/118; 297/345, 297/412, 416, 413, 411, 423, 414, 384, 422

[56] References Cited

UNITED STATES PATENTS

| | | | |
|---|---|---|---|
| 331,533 | 12/1885 | O'Connor | 297/384 X |
| 1,074,615 | 10/1913 | Folmer | 297/384 |
| 2,363,054 | 11/1944 | Fields et al. | 297/345 |
| 2,511,061 | 6/1950 | Hughes | 5/82 |
| 2,536,326 | 1/1951 | Thaden | 297/411 X |
| 2,549,902 | 4/1951 | Hibbard et al. | 297/422 X |
| 2,652,883 | 9/1953 | Holtzendorff | 297/423 |
| 2,683,482 | 7/1954 | Puls | 297/384 X |
| 2,796,915 | 6/1957 | Fox | 297/423 X |
| 3,469,268 | 9/1969 | Phillips | 5/82 |

*Primary Examiner*—Roy D. Frazier
*Assistant Examiner*—Peter A. Aschenbrenner
*Attorney, Agent, or Firm*—Dominick Nardelli

[57] ABSTRACT

A chair, especially useful for children with cerebral palsy, which has a board-type backrest integral with a board-type seat which are mounted on suitable legs that have adjustment means to adjust the height of the seat. The backrest is provided with a chest strap for strapping a child's chest erect. Means are provided for moving the chest strap vertically along the backrest. Arm rests are adjustably fastened to the backrest to be adjusted in and out, and up and down. The seat is provided with a post to inhibit leg adduction and is movable towards and away from the backrest.

2 Claims, 4 Drawing Figures

SIMPLIFIED ADJUSTABLE CHAIR FOR CHILDREN WITH CEREBRAL PALSY

FIELD OF THE INVENTION

This invention relates to medical or invalid chairs and, more specifically, to a simplified economical chair suitable to accommodate children with cerebral palsy and helping the child develop more normally.

BACKGROUND OF THE INVENTION

Ordinary or conventional chairs are not adequate to assist and satisfy the special needs of children with cerebral palsy. However, in the past, adjustable chairs have been developed to support cerebral palsied children. These chairs were developed to provide a more comfortable rest for the child instead of trying to rehabilitate the child by developing his muscles to support himself. For example, U.S. Pat. No. 3,761,126 is such a chair of the prior art. This chair, besides being expensive, is complicated to use.

SUMMARY OF THE INVENTION

Briefly, my novel chair consists of a board-type seat fastened primarily to a board-type backrest so that the two form substantially a right angle. Depending from the seat in fixed relation thereto are a pair of apertured brackets with apertures vertically disposed therein, preferably into two columns. To each of these apertured brackets there is bolted, with wing-nuts, leg plates which have at least a pair of holes near the upper edge to provide vertical adjustment to the seat. The backrest is provided with a pair of vertically disposed slots so that a chest strap is capable of passing in one slot and out the other. In addition, a pair of rod-like arms are provided with a threaded stud projecting from one end. The backrest is also provided with a pair of grouped holes, each group disposed exterior of the respective slots so that the stud on the arm can be inserted in any one of the holes and held in place with a wing-nut. To assist the child in sitting erect, the seat is provided with a centerline slot extending toward the backrest and a post to inhibit leg adduction, having a threaded stud extending from the lower end, is disposed through the slot and held tight with a wing-nut. This post adjusts forward and backward to suit the size of the child.

OBJECTS OF THE INVENTION

An object is to provide an economical simplified chair to be used with cerebral palsied children.

Another object is to provide a chair to encourage self-correction of improper sitting posture.

Another object is to provide a chair that inhibits both leg adduction and hyperextension of the total body.

Another object is to provide a chair to assist acquisition of head and trunk control.

Another object is to provide a chair to position a child for sitting activities.

Another object is to provide an adjustable chair which will be the correct size for the child as he continues to grow.

Another object is to provide a chair that gives the needed assistance to encourage correct sitting and that eliminates the assistance as the child develops.

These and other objects and features of advantage will become more apparent after studying the following description of the preferred embodiment of my invention, together with the appended drawings.

DETAILED DESCRIPTION OF THE DRAWING

Figure 1:
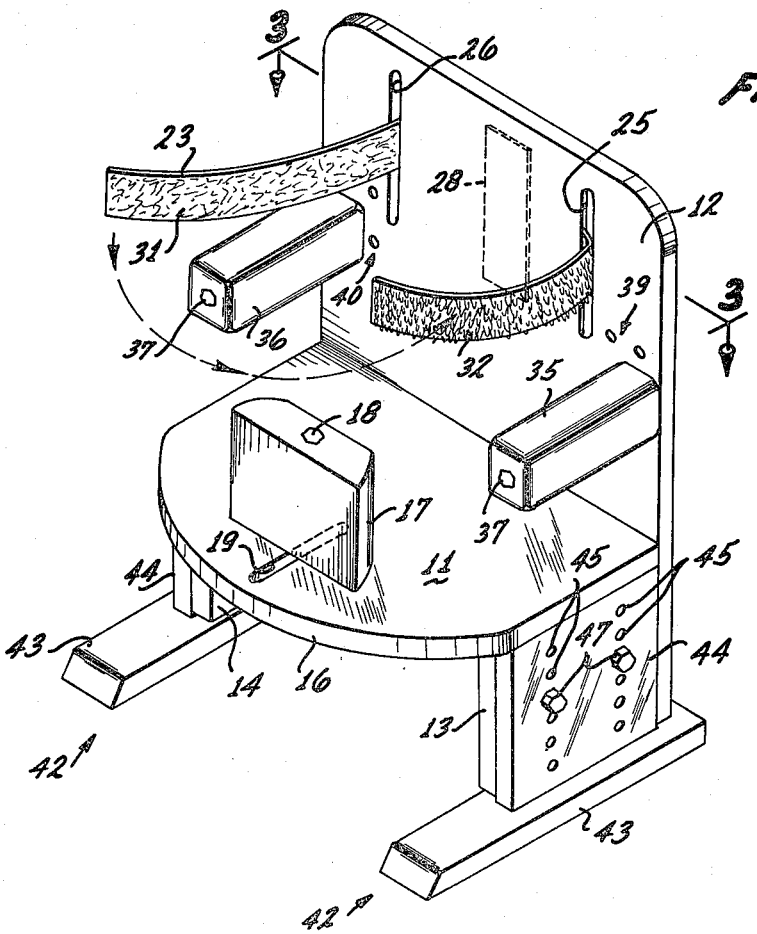
FIG. 1 is a pictorial view of the novel chair.

Referring to the drawing wherein the preferred embodiment of my novel chair is shown, the chair has a board-type seat 11 which is disposed at right angles to a board-type backrest or back 12. Below the seat 11 are disposed brackets 13 and 14 which are fixed to both the seat 11 and back 12 to provide rigidity and also vertical seat adjustment, as will be explained hereinafter. The forward edge of the seat 11 is formed with a suitable curvature 16 for reasons that will be explained hereinafter. On seat 11 is disposed a leg adduction post 17 which is mounted in place by a nut and bolt means, for example, a bolt 18 extending through a slot 19, formed in the seat 11 and directed fore and aft. A wing-nut 21 (FIG. 2) secures the post 17 in place. As shown, the post 17 is made somewhat wedge-shaped wherein the post 17 is narrower near the back than at the front to inhibit adduction of the child's legs.

Figure 3:
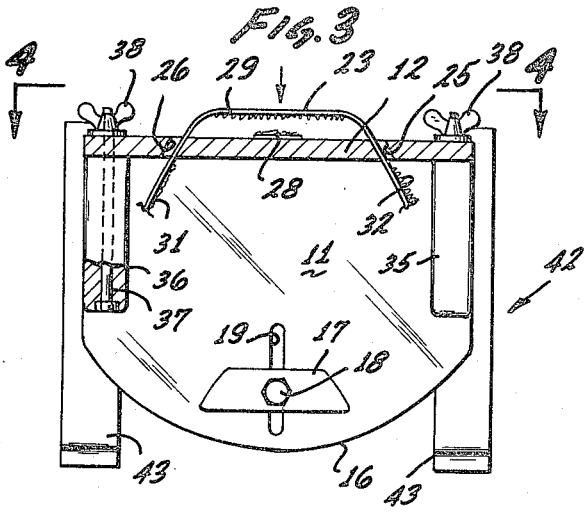
FIG. 3 is a sectional view looking down on the chair, and taken on plane 3—3 of FIG. 1.
Figure 4:
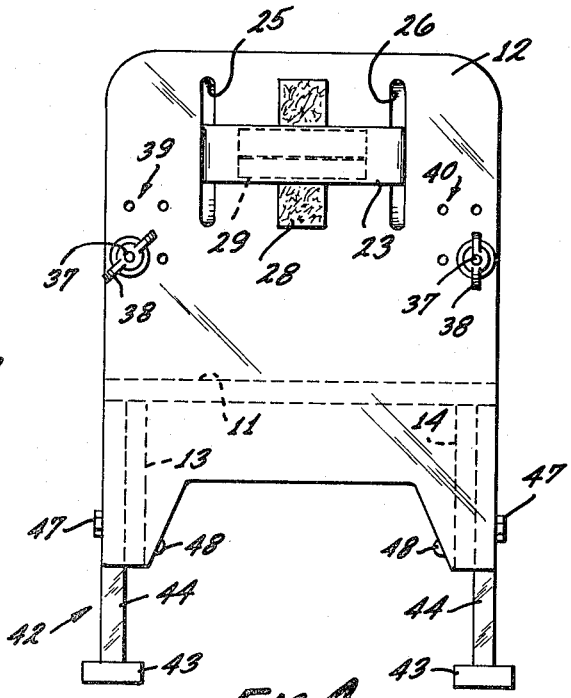
FIG. 4 is a back elevation of the chair as viewed on line 4—4 of FIG. 3, with the seat also in a raised position.

Since my chair has utility for training the muscles of a child with cerebral palsy to become strong so that the child could be able to sit up by himself, the chair is provided with a chest support strap 23. This strap extends through spaced vertical slots 25 and 26 in the back 12 so that the strap is able to accommodate a child as he grows. To prevent the strap 23 from falling out of the slot, the rear side of the back 12 has a standard and well known first type VELCRO strip 28 and the strap also has a standard second type VELCRO strip 29. As everyone in the art knows, VELCRO strips 28 and 29 are of two different types to form a strong bond when the two are pressed together. They are made so that one strip can be readily peeled off the other by a peeling action. The ends of the strap 23 are also provided with VELCRO strips 31 and 32 so the ends can be secured together. As shown in FIG. 3, the slots 25 and 26 are slanted through the back 12 to provide greater comfort to the child. In addition, the chair is provided with removable and adjustable arm rests 35 and 36, each of which is provided with a nut and bolt means, for example, a bolt 37 extending through the arm rest and a wing-nut 38. The bolt 34 can be inserted through a plurality of holes 39 and 40, formed in the backrest 12. In this arrangement, many holes are more desirable than a slot, as the holes allow adjustment in two directions instead of one. One understands that studs (not shown) could be substituted for either one of the bolts 37 and 18.

Figure 2:
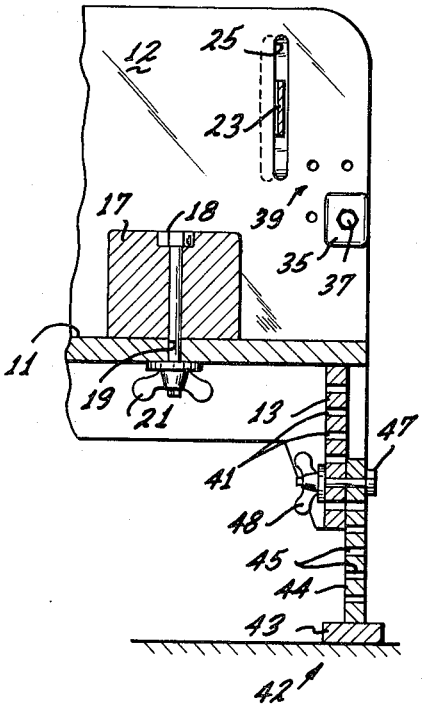
FIG. 2 is a front elevation of the right side of the chair shown in partial sections, with the seat in a raised position.

As the child grows, the height of the seat 11 should be raised so that the child's feet rest firmly on the floor to allow for more complete development of the child's muscles. Therefore the brackets 13 and 14 are each provided with two columns of holes 41, of which one column is shown in FIG. 2. A pair of legs 42 are provided, fastenable to each bracket. Each leg has a foot 43 to which is fixed a vertical plate 44, which, like brackets 13 and 14, have two columns of holes 45, which match holes 41 in brackets 13 and 14. Bolts 47 and wingnuts 48, in combination with holes 41 and 43, provide the vertical adjustment means for the seat 11. As one can see, this chair can be economically constructed. In fact, the seat 11, back 12, brackets 13 and 14, legs 43 and plate 44 have been made of ¾ inch thick plywood. The arm rests 35 and 36 have been made of 2 × 2 inch finished stock lumber, and the post 17 from 2 × 4 inch finished stock lumber. This chair provides some support for the child, but he is not completely supported, thereby teaching him to develop his muscles. As the child's strength develops, one or more of the restraints can be removed. For example, one may find that the arm rests 35 and 36 may be removed first.

Having described the preferred embodiment of my invention, one skilled in the art, after studying the foregoing description, can devise other embodiments without departing from the spirit and scope of my invention. Therefore, my invention is not to be considered as limited to the preferred embodiment, but is to be considered to include all embodiments falling within the scope of the appended claims.

I claim:

1. An adjustable chair for children with cerebral palsy, the chair comprising:

a board-type back;

a board-type seat, fixed to said back at substantially right angles;

a pair of parallel disposed board-type brackets fixed to the underside of said seat, so that said brackets support said seat;

said back having a pair of parallel vertically disposed slots formed therein;

a strap disposed within said slots so that it is movable in a vertical direction;

means on the strap to fasten the ends thereof;

a pair of adjustable, removable arm rests disposed to be fastened to said back;

said arm rests being elongated and each arm rest having a bolt passing through its length and beyond one end; said back having a plurality of holes adjacent each said vertical slot; said arm rests being adjustably attached to said back by inserting the extended portion of each bolt into one of said holes and securing it therein with a nut.

2. The chair of claim 1 wherein:

said seat has a normally disposed slot formed therein, disposed substantially normal to said back;

an adduction post is provided, having a bolt and nut means, and said post is disposed with the nut-equipped end of said bolt being detachably and adjustably connected with said seat through said normally disposed slot.

* * * * *